US006364793B1

(12) United States Patent
Valarik

(10) Patent No.: US 6,364,793 B1
(45) Date of Patent: Apr. 2, 2002

(54) ADHESIVE LAYER AND ITS APPLICATION TO HOCKEY STICK BLADES

(76) Inventor: Kamil Valarik, Skolska 747/22, 924 00 Galanta (SK)

( * ) Notice: Subject to any disclaimer, the term of this patent is extended or adjusted under 35 U.S.C. 154(b) by 0 days.

(21) Appl. No.: 08/809,315

(22) PCT Filed: Sep. 22, 1994

(86) PCT No.: PCT/SK94/00003

§ 371 Date: Mar. 14, 1997

§ 102(e) Date: Mar. 14, 1997

(87) PCT Pub. No.: WO96/09096

PCT Pub. Date: Mar. 28, 1996

(51) Int. Cl.[7] ..... A63B 59/14
(52) U.S. Cl. ..... 473/563
(58) Field of Search ..... 473/FOR 184, 473/563

(56) References Cited

U.S. PATENT DOCUMENTS

| | | | | |
|---|---|---|---|---|
| 2,912,245 A | | 11/1959 | Gardner et al. | |
| 3,458,194 A | | 7/1969 | Coles | |
| 4,768,787 A | | 9/1988 | Shira | |
| 5,332,212 A | * | 7/1994 | Susi et al. | 473/563 |

FOREIGN PATENT DOCUMENTS

| | | | | |
|---|---|---|---|---|
| CA | 909814 | * | 9/1972 | 473/FOR 189 |
| CA | 984420 | * | 2/1976 | 473/FOR 189 |
| CA | 1178983 | | 12/1984 | |
| GB | 547946 | | 9/1942 | |

* cited by examiner

*Primary Examiner*—Mark S. Graham
(74) *Attorney, Agent, or Firm*—Jordan and Hamburg LLP

(57) ABSTRACT

An adhesive layer on at least one side of a hockeystick blade is 0.01 to 8 mm thick and made of ceramics, limestone, glass, rubber, textile, plastics consisting of 0,01 to 8 mm grains. The adhesive layer is equipped on one side with self-adhesive material, and the thus adapted layer is pressed on by sinking it into the blade surface. Alternatively, it may be made by pressure spraying.

4 Claims, 1 Drawing Sheet

ADHESIVE LAYER AND ITS APPLICATION TO HOCKEY STICK BLADES

BACKGROUND OF THE INVENTION

The invention relate to the to adaptation of a hockey-stick blade by an adhesive layer and to the manner of its application. The field of the invention is sports and pleasure, especially for games with a puck or ball.

The till now known hockey sticks use miscellaneous materials, whereby for the sake of constructional and material features and also owing to the surface finish, the blade surface of the hockey-stick is undesirably smooth. Till now known solutions with regard to hockey-sticks are involved with construction, shape, improvement of strength or improved joining of the perch with the blade. These solutions are only marginally involved in removing undesirable slipperiness of the blade and have only resulted in partial insufficiently effective solutions and mainly additional adaptations with very short service life, e.g. the hockey-stick blade wound by textile tapes, eventually ribbing of the blade. The disadvantage of this method is the fact that for instance, in the case of ribbing, the slipperiness decreases only partly at lowered strength of the blade. Moreover the technology requires expensive machine equipment and therefore its efficiency compared with costs is very low. Further the negative mark of the adaptation by ribbing is the worsened control of the puck leading and shortened service life of the hockey-stick. Often, to lower the blade slipperiness of the hockey-stick, additional banding by different textile tapes is used. These tapes partly lower the puck or ball slipping along the hockey-stick blade, whereby their effect is limited by short service life. Especially blade edges of the hockey-stick at contact spots with the playing surface are quickly worn out, torn and separated from the blade surface. Further, when using such a bandage treated hockey-stick blade on the ice surface, ice particles are caught in the tape and icing arises which increases the slipperiness and its inequality decreases the control of the puck or ball.

SUMMARY OF THE INVENTION

The invention solves, in a different manner from the till now known attempted solutions, the problem of hockey-stick blade slipperiness in an inexpensive manner with a resulting long service life of the blade surface. The substance of the solution according to the invention is that the hockey-stick blade surface is equiped at least on one side of the blade with a 0,01 to 8 mm thick adhesive layer made of a 0,01 to 8 mm grains of convenient material like for example corundum, ceramics, limestone, glass, rubber, textile and plastics. The adhesive layer made in the above mentioned manner removes drawback of till now known solutions eliminating the slipperiness of the hockey-stick blade surface, removes an incontrollable slipping of the puck or ball along the hockey-stick blade, improves and exacts the control of the puck or ball in game situations, increases the accuracy of passing or shooting to goal, enables a larger game variability and attractiveness, resulting in the players having an improved psychological state. Further advantages of the solution is that the adhesive layer on the hockey-stick blade can be applied in different colour combinations and it is possible to make figures and advertising inscriptions. The adhesive layer is applied on the hockey-stick blade so that the adhesive layer on one side is equipped with self-adhesive material and the adapted layer is pressed on the blade surface whereby the adhesive layer can be applied also by embedding it into the blade surface or forming the layer by spraying.

DETAILED DESCRIPTION OF THE INVENTION

Figure 1:
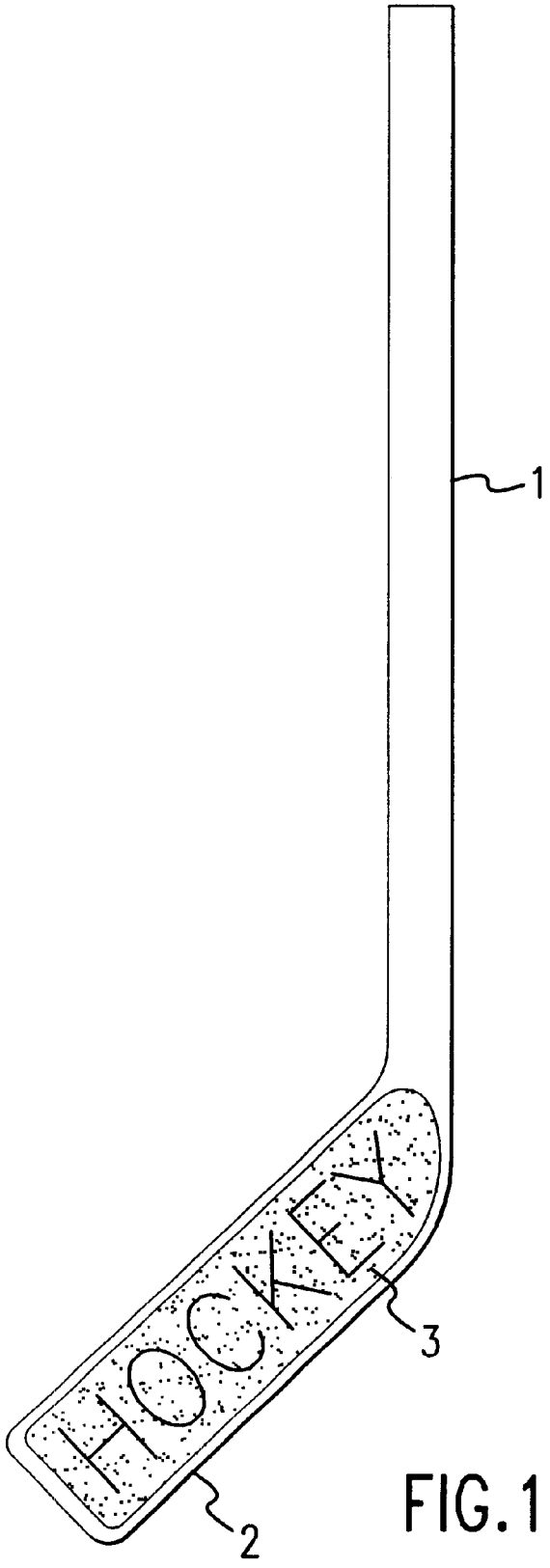
FIG. 1 is a hockey stick having a blade of the present invention.

The invention is illustrated in FIG. 1, which depicts a hockey stick 1 having a blade 2 with an adhesive layer 3 thereon. The adhesive layer can be applied so that figures and advertising inscriptions are depicted therein. For example, the adhesive layer 3 in FIG. 1 spells out the word "HOCKEY."

Example 1

On a hockey-stick, the stick and blade of which is made of wood with dimensions of the blade length 25 cm and width 7 cm, a 0,1 mm thick adhesive layer consisting of 0,1 mm grains is applied as a self-adhesive layer.

Example 2

On a hockey-stick made of pressed laminate a 3 mm thick adhesive layer consisting of 3 mm glass grains is applied to both sides of the blade, which is embedded 2 mm deep into the blade surface and it is applied by pressure spraying.

Example 3

On a wooden hockey-stick on both sides of the blade in a direction from the rounded end to two-thirds across the blade hot pressed adhesive layer made of 0,7 mm Novodur is applied.

The invention can be used in all sports games using hockey-sticks or other sporting sticks. The subject of the invention is applicable in single part production and series production. The application and application manner can be used as part of the technological operation of the production process.

What is claimed is:

1. A hockey-stick blade having a 0.01 to 8 mm thick adhesive layer on at least one side thereof, the adhesive layer comprising 0.01 to 8 mm grains of corundum, ceramics, limestone, glass, rubber, textiles and plastics.

2. A method of applying an adhesive layer on a hockey-stick blade comprising applying a self-adhesive layer on one side of the adhesive layer and pressing the self-adhesive layer onto the blade surface; the adhesive layer being 0.01 to 8 mm thick and comprising 0.01 to 8 mm grains of corundum, ceramics, limestone, glass, rubber, textiles and plastics.

3. A method of applying an adhesive layer on a hockey-stick blade comprising pressure spraying the adhesive layer; the adhesive layer being 0.01 to 8 mm thick and comprising 0.01 to 8 mm grains of corundum, ceramics, limestone, glass, rubber, textiles and plastics.

4. A method of applying an adhesive layer according to claim 2 or 3 wherein the adhesive layer is embedded into the blade surface.

* * * * *